US005971775A

United States Patent [19]

Tor et al.

[11] Patent Number: 5,971,775

[45] Date of Patent: Oct. 26, 1999

[54] SINGLE-SIDED, STRADDLE MOUNT PRINTED CIRCUIT BOARD CONNECTOR

[75] Inventors: Peng-Seng Tor; Joey Ng Kiat-Hup; Nai-Hock Lwee, all of Singapore, Singapore

[73] Assignee: Thomas & Betts International, Inc., Sparks, Nev.

[21] Appl. No.: 08/939,210

[22] Filed: Sep. 29, 1997

Related U.S. Application Data

[63] Continuation-in-part of application No. 08/735,852, Oct. 23, 1996.

[30] Foreign Application Priority Data

Jun. 25, 1996 [SG] Singapore ..... 9609134

[51] Int. Cl.[6] ..... H01R 9/09

[52] U.S. Cl. ..... 439/79

[58] Field of Search ..... 439/79, 80, 59, 439/328

[56] References Cited

U.S. PATENT DOCUMENTS

| | | | |
|---|---|---|---|
| 3,652,899 | 3/1972 | Henschen | 361/796 |
| 4,157,785 | 6/1979 | Freliech | 236/1 G |
| 4,416,496 | 11/1983 | Brefka | 439/59 |
| 4,695,112 | 9/1987 | Maston et al. | 439/350 |
| 4,712,848 | 12/1987 | Edgley | 439/327 |
| 4,734,042 | 3/1988 | Martens et al. | 439/62 |
| 4,993,108 | 3/1980 | Ramano | 15/383 |
| 5,096,435 | 3/1992 | Noschese et al. | 439/260 |
| 5,184,961 | 2/1993 | Ramirez et al. | 439/59 |
| 5,277,611 | 1/1994 | Berek et al. | 439/325 |
| 5,478,247 | 12/1995 | Chen et al. | 439/326 |
| 5,647,755 | 7/1997 | Hida et al. | 439/328 |
| 5,743,751 | 4/1998 | Davis et al. | 439/79 |

FOREIGN PATENT DOCUMENTS

| | | |
|---|---|---|
| 61-100256 | 1/1988 | Japan . |
| 1-140896 | 8/1991 | Japan . |
| 2-94392 | 4/1992 | Japan . |
| 4-322088 | 11/1992 | Japan . |
| 7-153507 | 6/1995 | Japan . |
| 0024141 | 2/1996 | Singapore . |
| 0028291 | 4/1996 | Singapore . |
| 0038853 | 4/1996 | Singapore . |
| 0038881 | 4/1996 | Singapore . |
| 0038965 | 4/1996 | Singapore . |
| 0030318 | 6/1996 | Singapore . |
| 0030360 | 6/1996 | Singapore . |
| 00302488 | 8/1996 | Singapore . |
| 0032351 | 8/1996 | Singapore . |
| 0032393 | 8/1996 | Singapore . |
| 0032409 | 8/1996 | Singapore . |
| 0032436 | 8/1996 | Singapore . |
| 0032441 | 8/1996 | Singapore . |
| 0032443 | 8/1996 | Singapore . |
| 0032448 | 8/1996 | Singapore . |
| 0032459 | 8/1996 | Singapore . |
| 0032487 | 8/1996 | Singapore . |
| 0032501 | 8/1996 | Singapore . |
| 0032505 | 8/1996 | Singapore . |
| 0032520 | 8/1996 | Singapore . |
| 0033384 | 10/1996 | Singapore . |
| 0033444 | 10/1996 | Singapore . |
| 0033475 | 10/1996 | Singapore . |
| 0033508 | 10/1996 | Singapore . |
| 0033545 | 10/1996 | Singapore . |
| 0033618 | 10/1996 | Singapore . |

*Primary Examiner*—Neil Abrams
*Assistant Examiner*—Barry M.C. Standig
*Attorney, Agent, or Firm*—Hoffmann & Baron, LLP

[57] ABSTRACT

A single-sided, straddle mount printed circuit board edge connector positively mechanically locks the connector to the circuit board using a plurality of gripper arm assemblies spaced along the connector housing. The gripper arm assemblies each include an upper and lower gripper arm defining therebetween a printed circuit board receiving space. The gripper arm assemblies positively mechanically lock the printed circuit board to the connector without the use of through holes and screws. The connector overcomes the disadvantages of connector tilt problems, manufacturability and simplicity in assembling the connector and printed circuit board.

6 Claims, 8 Drawing Sheets

SINGLE-SIDED, STRADDLE MOUNT PRINTED CIRCUIT BOARD CONNECTOR

This a continuation-in-part application of U.S. Ser. No. 08/735,852, filed on Oct. 23, 1996.

BACKGROUND OF THE INVENTION

1. Field of the Invention

This invention relates to electrical connectors and more particularly to an electrical connector for connection to an edge of a single-sided printed circuit board.

2. Description of the Prior Art

There are a wide variety of electrical connector assemblies which are adapted to be mated to an edge of a printed circuit board. Many of these edge connectors include a mating slot which receives a tongue portion projecting from an edge of a printed circuit board. Many such connectors also include fastening means, such as screws or bolts, for mounting the connector housing to the printed circuit board.

In most such electrical edge connectors which have elongated slots for receiving an edge portion or end of a board, a plurality of terminals are mounted in the housing along the slot, and spring contact portions of the terminals are biased against contact pads on either one or both sides of the printed circuit board. These types of connectors generally suffer from the disadvantage of connector tilting which may cause interruption of the electrical pathway or bending of the contacts. To overcome this problem, many connectors rigidly clamp the board within the connector slot against movement perpendicular to the plane of the board. Such clamping often includes the use of screws traversing holes found in the printed circuit board. Such through-hole clamping means is not suitable for certain manufacturing and assembly processes, such as oven/IR reflow soldering.

Rigidly clamping the connector to the printed circuit board causes a myriad of other problems. Such problems include the spring contact portions of the terminals losing their resiliency and, accordingly, the effective biased engagement with the pads on the printed circuit board. Additionally, problems arise from stress cracks produced in the areas surrounding the fastening means which lock the connector to the board. Such stress cracks may create open circuits if the crack traverses a printed circuit.

To avoid the problems associated with edge connectors, conventional header designs are typically surface mount connectors or right-angle connectors. Surface mount connectors usually use "hooks" to secure the connector to the printed circuit board. This design suffers greatly from connector tilling problems, similar to the previously described edge connectors, as well as problems associated with solder lead coplanarity control. These problems lead to connector manufacturing difficulties and poor solder joint formation during automated soldering processes to couple the solder leads to the solder pads of the printed circuit board.

Right-angle connectors also suffer the disadvantage of tilting as well as kinking of the solder leads which are used to assist in holding the connector upright.

To avoid tilting and kinking problems, these connectors generally utilize screws and mating through holes on the printed circuit board to rigidly couple the connector to the board. Thus, right-angle connectors suffer from the disadvantages set forth above regarding stress cracks as well as manufacturing and assembling difficulties discussed above.

The present invention overcomes the problems set forth above to provide a superior design substitute for surface mount and right-angle printed circuit board connectors.

SUMMARY OF THE INVENTION

It is an object of the present invention to provide an improved single-sided, straddle mount connector for mounting to a printed circuit board.

It is a further object of the present invention to provide a single-sided, straddle mount printed circuit board edge connector having improved positive grip on the printed circuit board.

It is yet another object of the present invention to provide a single-sided, straddle mount printed circuit board edge connector having improved Z-height control without sacrificing connector rigidity.

It is still a further object of the present invention to provide a single-sided, straddle mount printed circuit board edge connector having improved solder joint formation by positively pre-loading the leads onto the printed circuit board to ensure good mating contact.

It is yet another object of the present invention to provide a single-sided, straddle mount printed circuit board edge connector adapted to accommodate and correct warpage of thin printed circuit boards which often occurs during the soldering process.

It is still a further object of the present invention to provide a single-sided, straddle mount printed circuit board edge connector having a plurality of gripper or arm assemblies on the connector which provide an effective means for correcting printed circuit board warpage.

It is still a further object of the present invention to provide a single-sided, straddle mount printed circuit board edge connector having positive grip gripper arm assemblies on the connector which eliminate tilting of the connector with respect to the printed circuit board.

It is yet another object of the present invention to provide a single-sided, straddle mounted printed circuit board edge connector having improved coplanarity control of solder leads, leading to simpler and easier manufacturing processes due to increased tolerances.

It is still another object of the present invention to provide a plastic, single-sided, straddle mount printed circuit board edge connector which provides enhanced plastic rigidity using I-beam and C-channel designs for the gripper arm assemblies.

It is yet a further object of the present invention to provide a plastic, single-sided, straddle mount printed circuit board edge connector which improves plastic material flow to thin sections of the connector during injection molding.

In accordance with one form of the present invention, the connector for edge mounting onto a single-sided printed circuit board includes an insulative housing having top and bottom walls, opposed side walls, and a rear wall forming a header assembly. The rear wall includes at least one opening extending therethrough and having positioned therein an electrical contact. The electrical contact includes a contact pin portion which is positioned within the header assembly and a solder lead extending from the rear wall of the housing in a direction opposite from the header assembly. The connector further includes a plurality of gripper arm assemblies which are spaced along the insulative housing and extend perpendicular from the rear wall of the header portion of the connector in the direction of the solder lead. Each of the gripper arm assemblies includes an upper and lower gripper arm defining therebetween a receiving space for receiving the edge of the printed circuit board. The gripper arm assemblies provide positive mechanical locking of the printed circuit board to the connector so that the solder lead is in mating electrical connection with the solder pad of the printed circuit board upon insertion therein.

The gripper arm assemblies may be in the form of simply providing an upper and lower gripping arm or, in the alternative, may be configured as either an I-beam or C-channel shaped. In the gripper arm assembly configured in the shape of an I-beam, the assembly includes upper and lower gripper arms and a vertical extending member disposed between and coupled to the upper and lower gripping arms to form substantially an I-shaped cross-section. In order for the printed circuit board to be inserted into the I-beam shaped gripper arm assembly, the printed circuit board includes a slot therein for mating engagement with the vertical extending member of the I-beam.

The gripper arm assembly configured in the shape of a C-channel includes a vertically extending member coupling an outside surface of the upper and lower gripper arms to form the gripper arm assembly having a C-shaped cross-section. Depending on the location of the C-channel shaped gripper arm assembly along the edge of the printed circuit board, the printed circuit board may include a slot therein for mating engagement with the vertical extending member of the C-channel.

The connector is preferably integrally molded to include the header and gripper arm assemblies as a unitary body. The contacts may be press fit into openings in the rear wall of the header assembly to form the connector in accordance with the present invention. The gripper arm assemblies of the present invention provide superior mechanical connection to the printed circuit board and avoids connector tilting problems without the use of any fastening means such as through holes and screws. The connector of the present invention also provides an easily manufacturable structure which can be simply assembled onto an edge of a single-sided printed circuit board.

A preferred form of the single-sided, straddle mount printed circuit board connector, as well as other embodiments, objects, features and advantages of this invention will be apparent from the following detailed description of illustrative embodiments thereof, which is to be read in conjunction with the accompanying drawings.

DETAILED DESCRIPTION OF THE PREFERRED EMBODIMENTS

Figure 1:
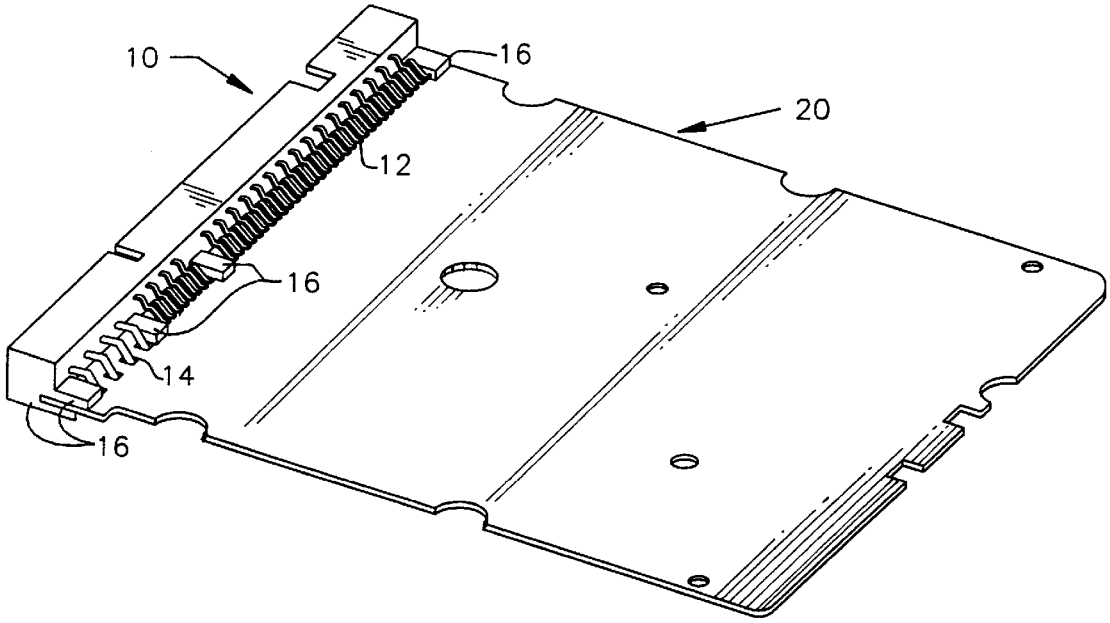
FIG. 1 is a top perspective view of the single-sided, straddle mount connector formed in accordance with the present invention coupled to an edge of a printed circuit board.

FIG. 1 is a top perspective view of a single-sided, straddle mount connector 10 formed in accordance with the present invention coupled to an edge of printed circuit board 20. The connector 10 includes a plurality of contacts or solder leads 12 which are in electrically mating connection with solder pads 14 located on a top surface of the printed circuit board 20. Also shown in FIG. 1 are a plurality of connector gripper arm assemblies 16 which provide a positive locking means for coupling the connector 10 to the edge of the printed circuit board.

The connector 10 is single-sided since the solder leads 12 are provided on only one side of the printed circuit board. Many prior art devices included solder pads on two opposing surfaces of the printed circuit board and a connector having top and bottom contacts for electrically contacting each solder pad. These types of double-sided printed circuit boards have many disadvantages, including manufacturing difficulties, such as those associated with double reflow and double-sided solder pasting. Since the present invention only requires a single side of the printed circuit board to include solder pads, manufacturing speed is increased and the above-mentioned difficulties are avoided. A printed circuit may be produced and easily pasted to a top surface of a substrate to form a printed circuit board.

Figure 2:
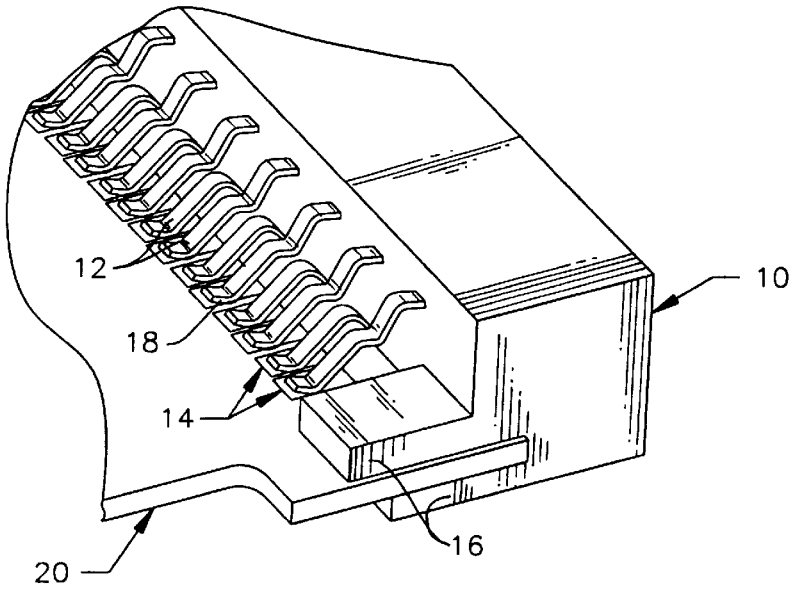
FIG. 2 is an enlarged detail of the connector and printed circuit board shown in FIG. 1.

FIG. 2 is an enlarged detail of FIG. 1. As clearly illustrated in FIG. 2, the connector contacts or solder leads 12 are spring-retention type contacts which are frictionally electrically connected to the solder pads 14 of the printed circuit board 20 upon insertion of the circuit board into the receiving space formed by gripper arm assemblies of the connector. The solder leads 12 are shaped to be biased against an inserted circuit board so that a solder tail 18 of the solder lead are electrically coupled with a solder pad of the circuit board. The solder leads 12 include at least one bend along its extent and the solder tail 18 is curled upward for receiving an edge of a printed circuit board 20 without scraping the circuit board surface.

Figure 3:
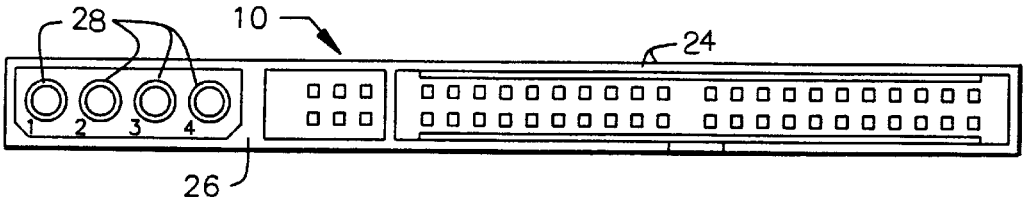
FIG. 3 is a rear elevational view of the connector header assembly formed in accordance with the present invention.
Figure 4:
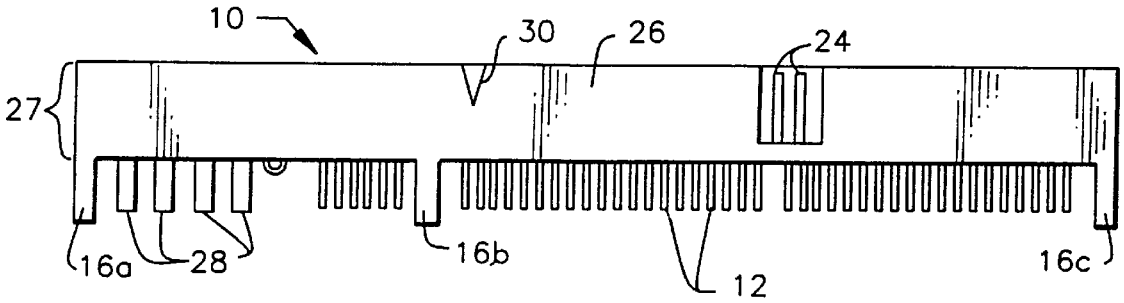
FIG. 4 is a top plan view of the connector formed in accordance with the present invention.

FIGS. 3 and 4 illustrate one embodiment of the header assembly of the single-sided straddle mount connector. More specifically, FIG. 3 is a rear elevational view of the connector illustrating the arrangement of male connection power pins 22 and signal pins 24. The connector housing 26 comprises an electrically insulative material, such as glass filled PPS or PPA. The connector includes a plurality of male power pins 22 for connection with a mating female power plug. Furthermore, the connector may include any number of signal pins 24, depending upon the application. FIG. 4 is a top plan view of the connector housing illustrating the gripper arm assemblies and spring retention contacts 28 coupled to the power pins and the contacts 12 coupled to the signal pins of the connector. In this particular illustrated embodiment, the connector includes three gripper arm assemblies, one gripper arm assembly at each end of the connector 16*a,* 16*c* and a third gripper arm assembly 16*b* located near a central portion of the connector. The connector housing also includes an indicator 30 which may be molded into the housing, for indication the position of the first signal pin positioned within the connector.

Figure 5:
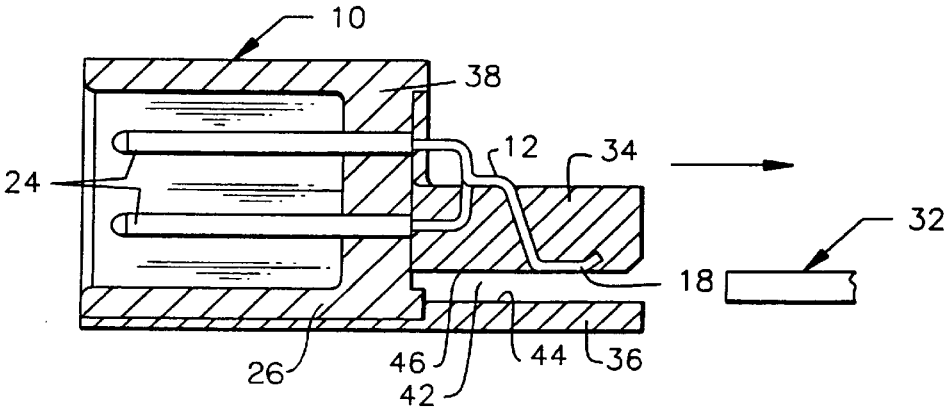
FIG. 5 is a cross-sectional view of a connector formed in accordance with the present invention illustrating the connector insertion direction onto an edge of a printed circuit board.

FIG. 5 is a cross-sectional view of the connector 10 of the present invention prior to connection with an edge of a printed circuit board 32. In practice, the connector will be moved along a plane in the direction of an edge of printed circuit board for mating mechanical and electrical connection therewith. The connector is manufactured to accommodate any specified printed circuit board thickness, e.g. 1.45 mm. Accordingly, the printed circuit board is frictionally fitted between an upper 34 and lower 36 gripper arm to positively mechanically hold the connector to an edge of the printed circuit board. The lower gripper arm 36 extends a sufficient length perpendicular to an edge of the printed circuit board to effectively support the connector on the edge thereof. For example, the lower gripper arm assembly is preferably at least 4 mm long extending from a rear wall 38 of the connector. The gripper arm assemblies may be any convenient width, and are typically 2 to 5 mm in width. By supporting the connector along its length with a plurality of gripper arm assemblies, connector tilting problems are avoided.

This arrangement of a plurality of gripper arm assemblies to positively lock the connector to the printed circuit board has numerous advantages of prior designs. For example, the novel arrangement of gripper arm assemblies eliminates the serious problem of connector tilt with respect to the printed circuit board. Additionally, the contacts or solder leads of the connector may be designed with positive pre-load interference to improve electrical contact with the printed circuit board solder pads without danger of tilting the connector. Furthermore, the arrangement of gripper arm assemblies serve as an effective means for correcting printed circuit board warpage, which feature will be discussed in greater detail later.

Figure 6A:
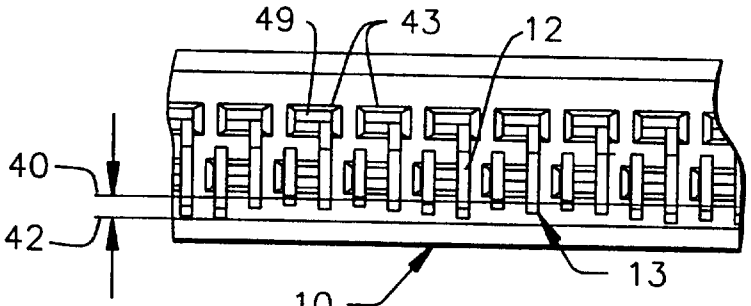
FIG. 6A is a front elevational view of the connector formed in accordance with the present invention illustrating the printed circuit board seating plane and the coplanarity tolerance of the connector solder leads.
Figure 6B:
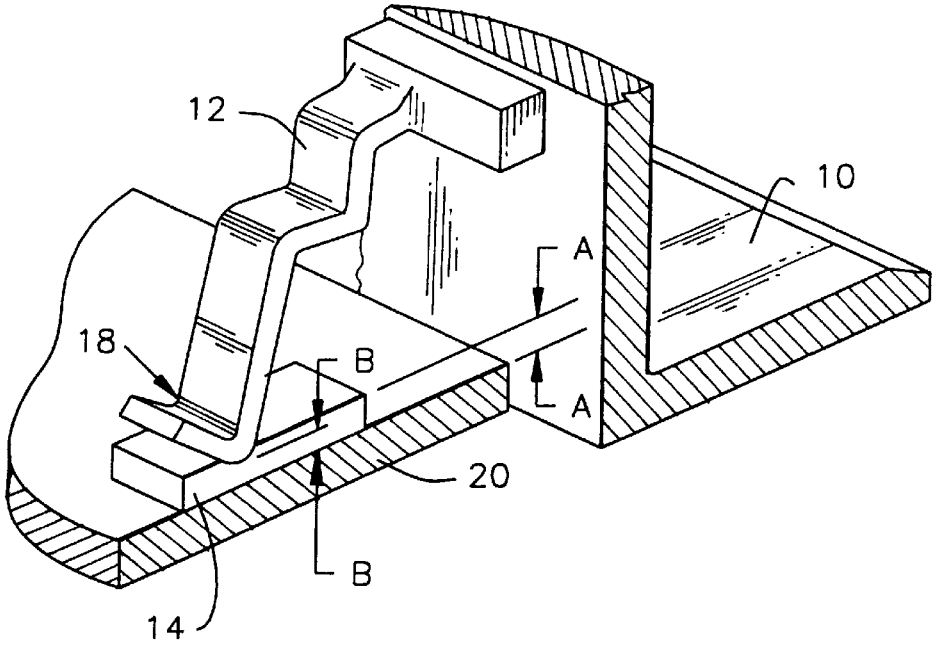
FIG. 6B is an enlarged perspective detail of the connector solder tail formed in accordance with the present invention in mating electrical connection with a solder pad of a printed circuit board.

FIG. 6A illustrates the positively pre-loaded solder leads formed in accordance with the present invention. More specifically, the solder leads 12 have solder tails 18 with a rounded contact surface which is set below a printed circuit board seating plane 40 defined by a gripper arm assembly receiving space 42. The receiving space 13 defined by an upper surface 44 of a lower gripper arm and a lower surface 46 of an upper gripper arm. (FIG. 5). Accordingly, the solder leads 12 are positively pre-loaded onto the printed circuit board solder pads to provide good electrical contact therewith. Additionally, as illustrated in FIG. 6A, control of coplanarity of the solder tails may be relaxed without sacrificing the ability to make good electrical contact with the printed circuit board. As shown in FIG. 6A, a printed circuit board seating plane is illustrated by dashed line 40. The contact tails will provide good electrical contact with the printed circuit board as long as the contact tails, in their relaxed position, are oriented below the seating plane of the printed circuit board. However, in the event that the solder tails 18 are formed above the printed circuit board seating plane, that is, there is an absence of preloading of the solder leads 12 onto the printed circuit board solder pads, good solder joints may still be attainable as long as the solder tails 18 do not lift off the printed circuit board seating plane by a distance more than the solder pad thickness (FIG. 6B). Typically, solder pads have a thickness of 0.15 mm as illustrated by arrows A—A in FIG. 6B. Accordingly, if the solder tail is formed above the printed circuit board seating plane by a distance less than the solder pad thickness, (shown by arrows B—B in FIG. 6B) good solder joints may be formed. The tolerance of coplanarity is indicated by the seating plane 40 and a lower limit illustrated by dashed line 42. Thus, connector manufacturing methods and processes become simplified in view of the increased tolerance permitted with respect to contact tail coplanarity. Also illustrated in FIG. 6A are the connector openings 43 through which the male contact pins and solder leads are mounted to the connector.

Figure 7:
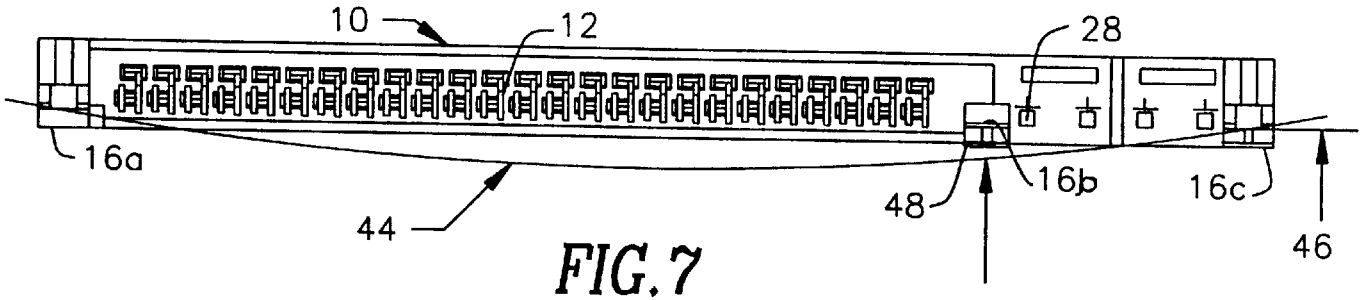
FIG. 7 is a front elevational view of the connector formed in accordance with the present invention and printed circuit board warp correction provided by the connector gripper arm assemblies.

FIG. 7 is a front elevational view of a single-sided, straddle mount connector of the present invention illustrated with a warped printed circuit board 44. Commonly, printed circuit boards tend to warp due to shrinkage or other post-manufacturing conditions. Due to this warping, it becomes very difficult, if not impossible, to use any form of edge connector and still obtain good electrical connection along the entire length of the connector. The present invention which includes a plurality of gripper arm assemblies can effectively correct printed circuit board warpage and ensure good electrical contact. As shown in FIG. 7, the single-sided, straddle mount connector includes three gripper arm assemblies 16*a,* 16*b,* 16*c,* illustrated in an I-beam configuration to be discussed in greater detail later, which upon connection to an edge of a warped printed circuit board 44, will tend to straighten and positively grip the printed circuit board. Warpage becomes a significant problem with thin printed circuit boards and, this problem can be rectified by the arrangement of gripper arm assemblies on a single-sided connector of the present invention. Once the warped circuit board is in place in the connector of the present invention, the circuit board warp is corrected to provide a substantially planar connection surface 46.

Figure 8:
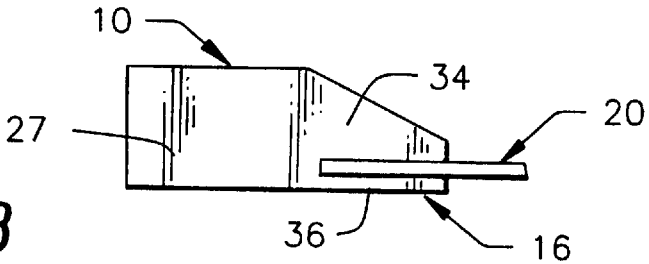
FIG. 8 is an end view of the connector and gripper arm assembly with a printed circuit coupled thereto.

FIG. 8 is an end view of the single-sided, straddle mount connector illustrating a gripper arm assembly having a single-sided, paste on printed circuit board seated within the gripper arm assembly receiving space. The gripper arm assembly includes a lower arm 36, having an upper surface which determines the Z-height (center line offset) of the printed circuit board. Specifically, depending upon the positioning and/or thickness of the lower gripper arm 36, the Z-height of the printed circuit board is determined. The particular configuration of the upper gripper arm 34 and lower gripper arm 36 provides superior Z-height control.

The connector housing 26 is preferably an integrally molded unit having the connector header 27 (FIGS. 3 and 4)

and gripper arm assemblies 16*a,* 16*b,* 16*c* integrally formed. The connector header includes top and bottom walls, opposed side walls and rear wall 38. The connector contacts, comprising a male connector pin at one end and a solder lead at an opposite end, may include rectangular transition section 49 (FIG. 6), which may be press fit into contact receiving spaces 43 molded into the housing. The contacts include a single-sided solder lead on the printed circuit board receiving side and male connector pins for coupling to mating female connectors within the header assembly of the connector. The gripper arm assemblies 16*a,* 16*b,* 16*c* include a receiving space 42 between the upper 34 and lower 36 gripper arms, the receiving space 42 being specifically dimensioned to receive a printed circuit board having a specified thickness.

In the embodiment shown in FIG. 8, the lower gripper arm 36 is substantially rectangular in shape and having a rectangular cross-section. The upper gripper arm 38 is also substantially rectangular in shape, but being tapered away from the header 27 towards the printed circuit board receiving space opening and having a substantially rectangular cross-section throughout its length.

The lower gripper arm 36 may include on a top surface thereof at least one projection or crush rib 48 extending upward from the top surface thereof to engage the lower surface of the printed circuit board. The at least one projection or crush rib 48 aids in providing a positive mechanical lock of the connector onto the edge of the printed circuit board. In one embodiment, a single crush rib may be centrally located on an upper surface of the lower gripper arm. Alternatively, as shown in FIGS. 7 and 9–11, a pair of crush ribs 48 may be provided on opposite sides of the lower gripper arm for deflection upon engagement with the lower surface of a printed circuit board.

Once good mechanical and electrical connections are formed by the gripper arm assemblies of the present invention, the solder tails may be fused to the solder pads of the printed circuit board. Such fusing may be accomplished by oven/IR reflow soldering thus providing a fast, reliable electrical connection therebetween.

Figure 9:
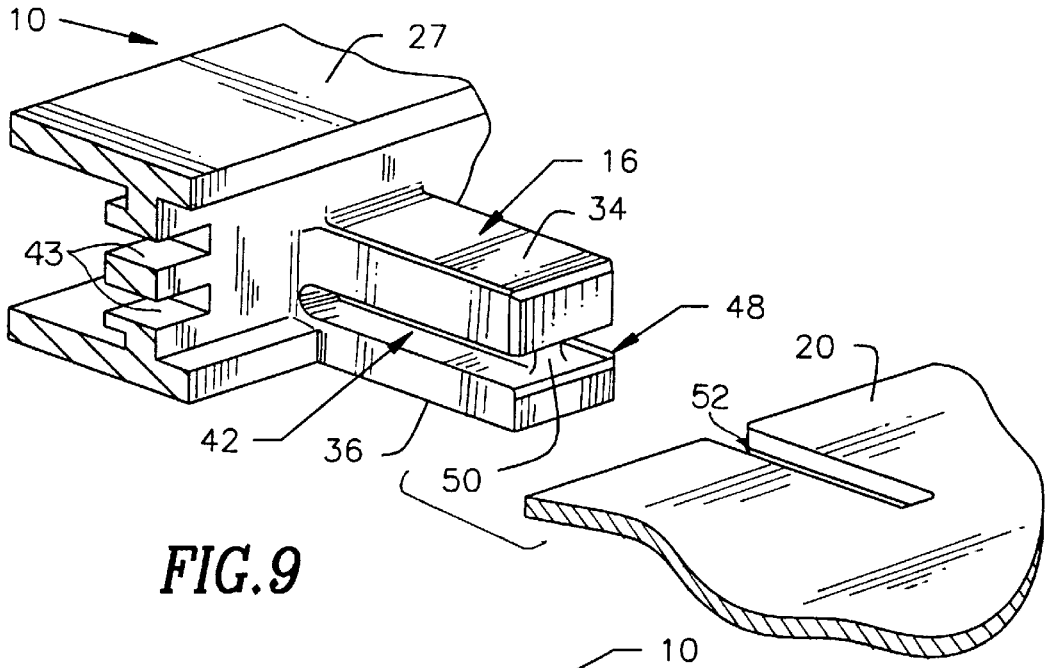
FIG. 9 is a perspective view of a connector gripper arm assembly configured in the shape of an I-beam and a mating portion of a printed circuit board.
Figure 10:
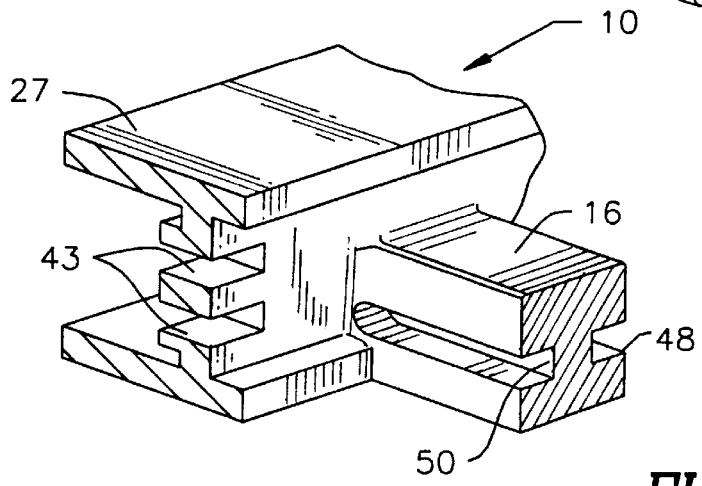
FIG. 10 is a vertical cross-sectional view of the gripper arm assembly configured in the shape of an I-beam illustrated in FIG. 9.
Figure 11:
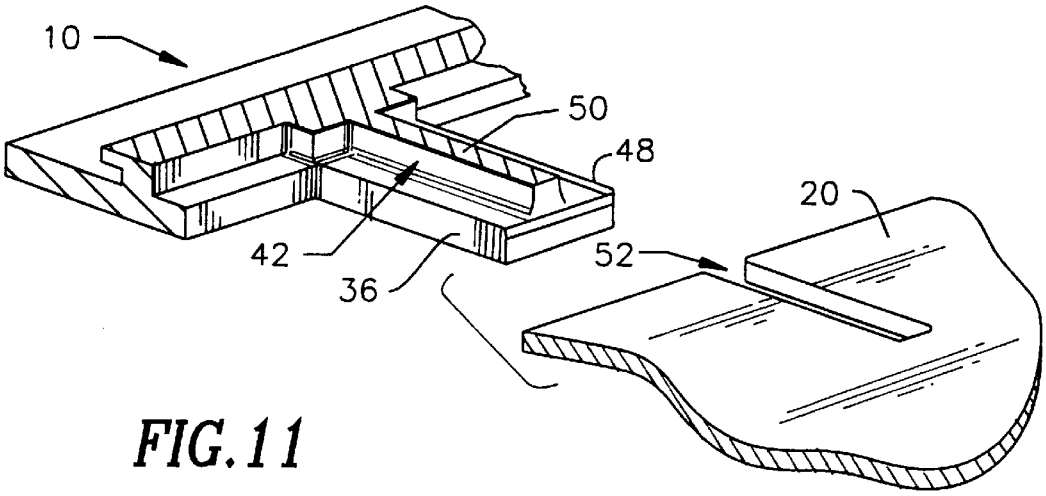
FIG. 11 is a horizontal cross-sectional view of the gripper arm assembly configured in the shape of an I-beam and a mating portion of the printed circuit board illustrated in FIG. 9.

FIGS. 9–11 illustrate alternative embodiments of forming the gripper arm assemblies of the present invention. More specifically, FIG. 9 illustrates a gripper arm assembly 16 and connector housing header wherein the gripper arm assembly has an I-beam construction. More specifically, the gripper arm assembly 16 includes a lower gripper arm 36 and an upper gripper arm 34 defining a printed circuit board receiving space 42 therebetween and a strengthening rib 50 assembly centrally located in the circuit board receiving space. The strengthening rib 50 is integrally formed into the lower surface of the upper gripper arm and the upper surface of the lower gripper arm. The I-beam construction provides enhanced strength to the gripper arm assembly.

The I-beam construction allows the thin plastic sections of the gripper arm assemblies to withstand heavier loads without risk of fracture. Since the I-beam construction provides enhanced strength to the gripper arm assembly, a wider range of Z-heights are available since the lower gripper arm may be made thinner without sacrificing connector load capabilities. However, when utilizing the I-beam construction, it will be necessary to provide a slot 52 in the printed circuit board for accommodating the strengthening rib of the gripper arm assembly as shown in FIG. 9. The slot 52 in the printed circuit board and I-beam construction of the gripper arm assembly act as a printed circuit board-to-connector alignment means. Accordingly, the printed circuit board solder pads will be closely aligned with the solder leads of the connector to ensure good electrical connection to all solder pads on the printed circuit.

Yet another advantage of the I-beam construction is improved manufacturability of the connector. More specifically, the connector is preferably injection molded plastic in an integrally formed device. However, problems may arise in the injection molding process due to poor plastic flow to thin sections of the connector, e.g. the gripper arm assemblies. The I-beam construction provides improved plastic flow to the thin sections of the gripper arm assemblies to enhance the overall plastic injection molding process.

Also shown in FIG. 9 are the crush ribs 48 which are provided on the upper By surface of the lower gripper arm 36. The crush ribs 48 are substantially triangular-shaped projections having a peak which extends above the upper surface of the lower gripper arm on opposing side edges thereof. As previously discussed, the crush ribs 48 are adapted to slightly deflect to ensure a positive mechanical lock of the connector to the edge of the printed circuit board. The crush ribs 48 are clearly illustrated in FIGS. 10 and 11 which are partial cross-sectional views of the connector and gripper arm assemblies shown in FIG. 9.

FIG. 10 is a partial vertical cross-sectional view of the connector housing and gripper arm assembly formed in accordance with the I-beam construction described above. Also illustrated in FIG. 10 are the openings 43 molded into the housing which are adapted to receive the connector contacts. As previously noted, the connector contacts may be press-fit into the housing openings 43 so that a male connection pin end is available for connection within the header portion of the connector and the solder leads 12 extend in an opposite direction for frictionally engaging solder pads on a top surface of a printed circuit board.

FIG. 11 is a partial horizontal cross-sectional view of the connector housing 27, strengthening rib 50 and lower gripper arm 36. The strengthening rib 50 is integrally molded to the connector housing and lower gripper arm. The strengthening rib 50 is dimensioned to fit within the slot 52 formed in the printed circuit board for alignment of the connector with the printed circuit board.

Figure 12:
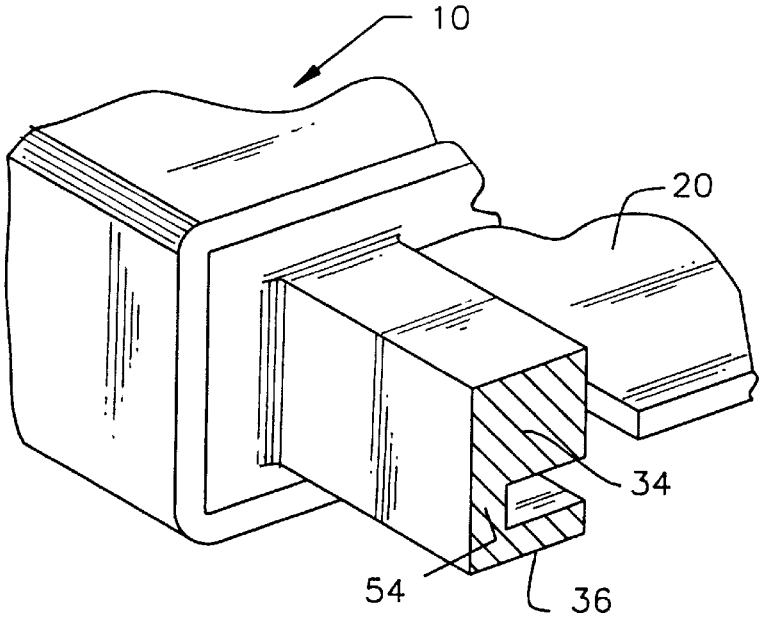
FIG. 12 is a vertical cross-sectional view of a connector gripper arm assembly configured in the shape of a C-channel.

FIG. 12 illustrates a further alternative embodiment in perspective view for the gripper arm assembly. FIG. 12 illustrates a partial vertical cross-section of a C-channel gripper arm assembly design in which a receiving space is defined between an upper 34 and lower arm 36 portion and a rear portion 54 connecting the upper and lower gripper arm portions. Once again, the C-channel design affords the strength advantages in the thin plastic sections of the gripper arm assembly. The C-channel design also allows for broader design options with respect to Z-height of the connector.

It should be understood by those skilled in the art that the different gripper arm assembly designs may be used in any combination in the connector design. For example, the connector may include C-channel design gripper arm assemblies on the end portions of the connector and at least one I-beam gripper arm assembly along the length of the connector. Alternatively, the connector may include all I-beam design gripper arm assemblies or standard gripper arm assemblies (FIG. 5) which include only an upper and lower gripper arm extending from the connector housing.

Figure 13:
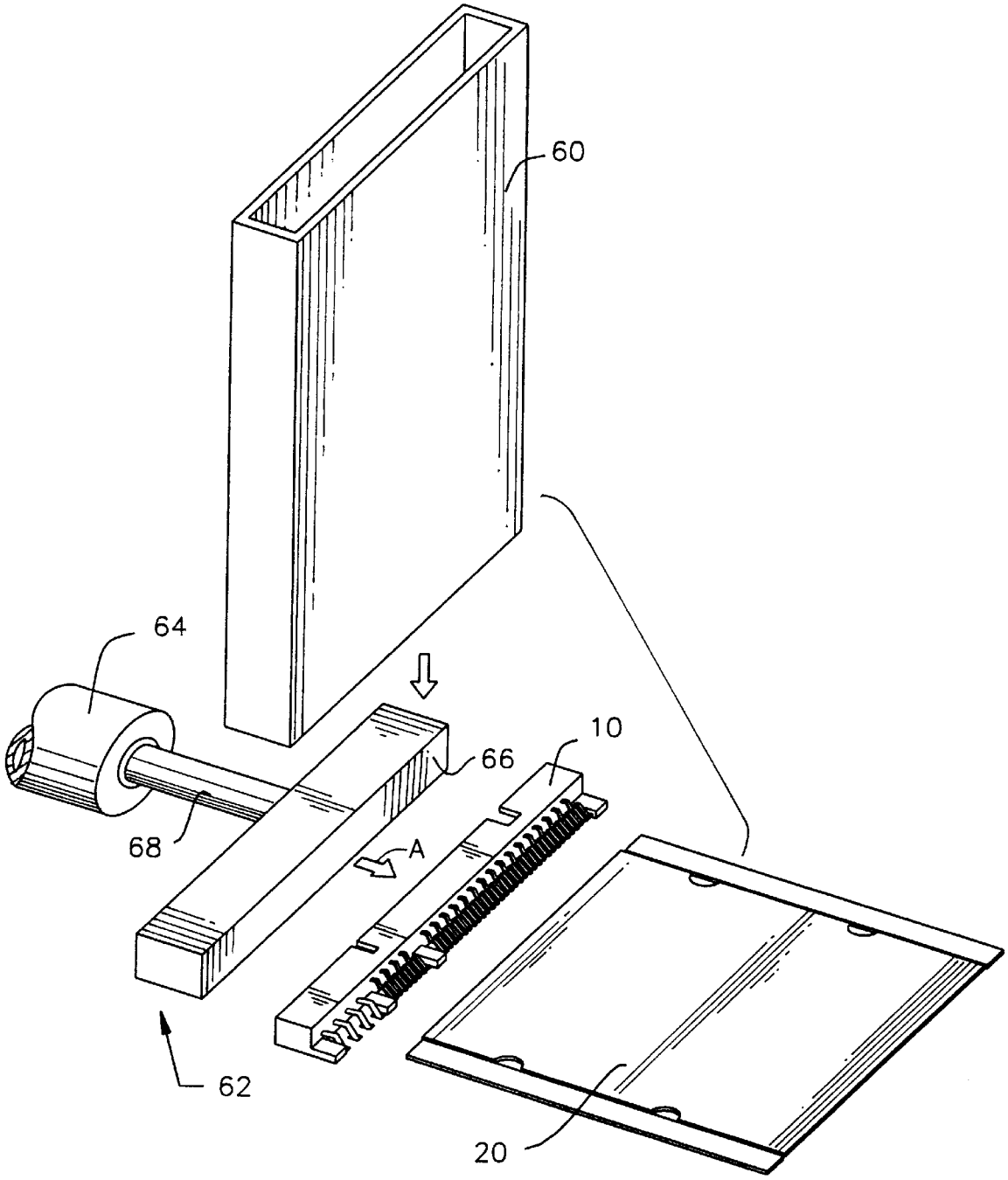
FIG. 13 is a perspective view of a simplified auto-insertion machine for coupling the connector on an edge of a single-sided printed circuit board.
Figure 14:
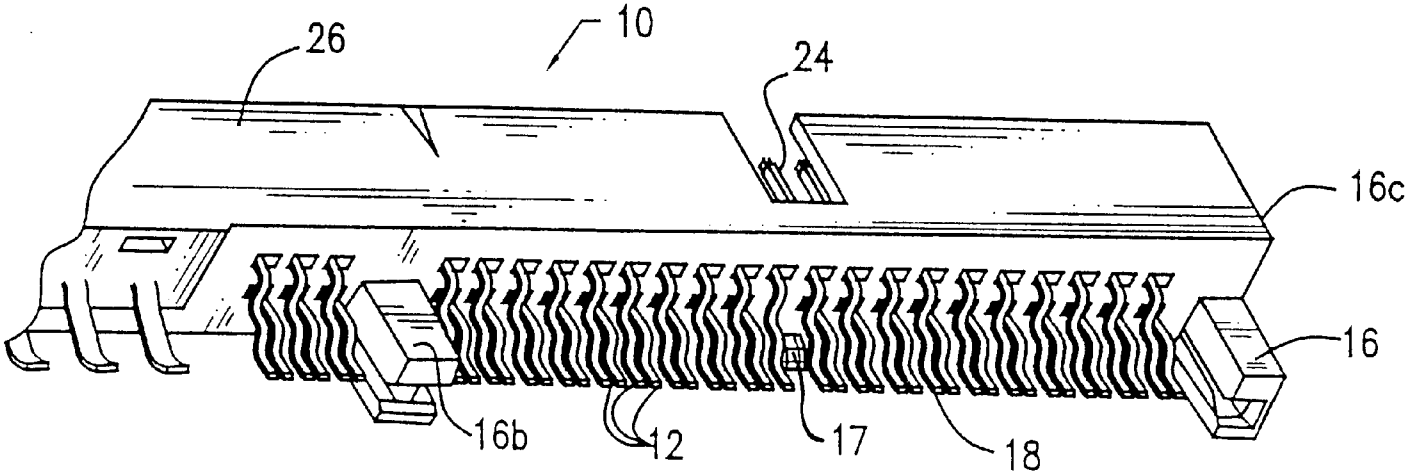
FIG. 14 is a partial front perspective showing of a further embodiment of the connector assembly of the present invention.
Figure 15:
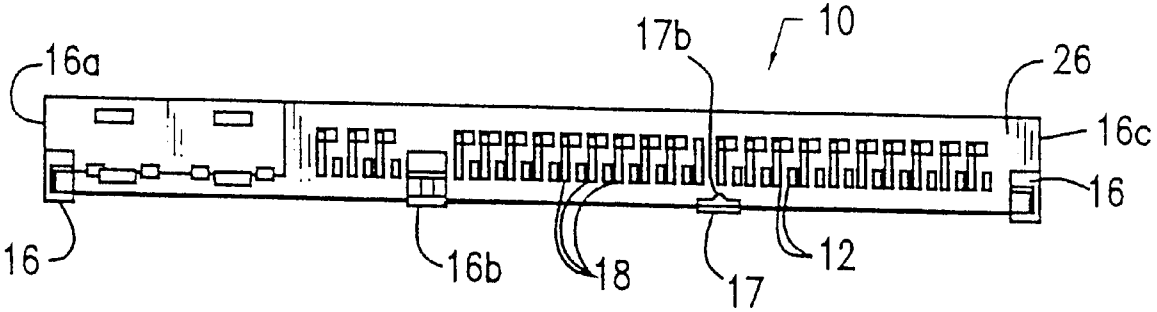
FIG. 15 is a back elevational view of the connector shown in FIG. 14.

FIG. 13 illustrates a simplified auto-insertion machine for coupling the single-sided, straddle mount connector of the present invention to an edge of a printed circuit board. The auto-insertion machine includes a magazine holder for stacking a plurality of connectors 10 and an insertion device 62 for pushing the connector 10 onto the edge of the circuit board 20. The insertion device includes a pneumatic cylinder 64 having an insertion block 66 coupled to the reciprocating rod 68 of the cylinder. Upon activation of the cylinder, the insertion block 68 contacts the header portion of the connector which is pushed in the direction of arrow A to contact an edge of the circuit board 20. The connector spring retention solder leads are frictionally, electrically coupled to the solder pads on the circuit board upon complete insertion of the connector onto the edge of the circuit board. A soldering process may then permanently fuse the solder leads to the solder pads. Accordingly, the present invention provides a positive mechanical lock and reliable electrical connection to a single-sided, printed circuit board utilizing a simple assembly process. The assembly process does not require any additional connection devices, such as threaded screws, to ensure good mechanical and electrical contact. The gripper arm assemblies positively engage the edge of the circuit board to ensure a good mechanical connection.

The single-sided, straddle mount printed circuit board connector of the present invention overcomes the disadvantages of surface mount and right-angle connectors, including connector tilting and provides positive mechanical and electrical coupling with the circuit board. Furthermore, the assembly process of the connector to the edge of the circuit board is simplified. Manufacturing of the connector is also simplified in view of the higher tolerances permitted for coplanarity of the contact solder tails without sacrificing good electrical connection to the solder pads of the printed circuit board. The connector of the present invention is also effective in correcting printed circuit board warpage using the gripper arm assemblies described herein.

As particularly shown in FIGS. 4, 6, and 7, the present invention provides for securing printed circuit board 40 to connector 10 in a manner which accommodates variation in the coplanarity of the solder tails 18 extending from housing 26. The present invention also compensates for a certain degree of printed circuit board warpage, assuring that such warpage of the printed circuit board is corrected thereby providing good electrical engagement between the solder tails 18 and the pads on one surface of the printed board over the entire length of the connector. As described above, this is achieved by use of gripper arms 16 which extend from housing 26. Particularly with respect to signal pins 24, both coplanarity of the solder tails 18 and printed board warpage is accommodated by gripper arm 16*c*, at one end of housing 26 and third gripper arm 16*b* located along a central portion of housing 26. While such arrangement and positioning of the gripper arms is adequate for the intended purposes, it is further contemplated that additional compensation for printed circuit board warpage and lack of coplanarity of solder tails may be further addressed by the addition of an intermediate gripper arm specifically associated with contacts 12 of signal pins 24.

Figure 16:
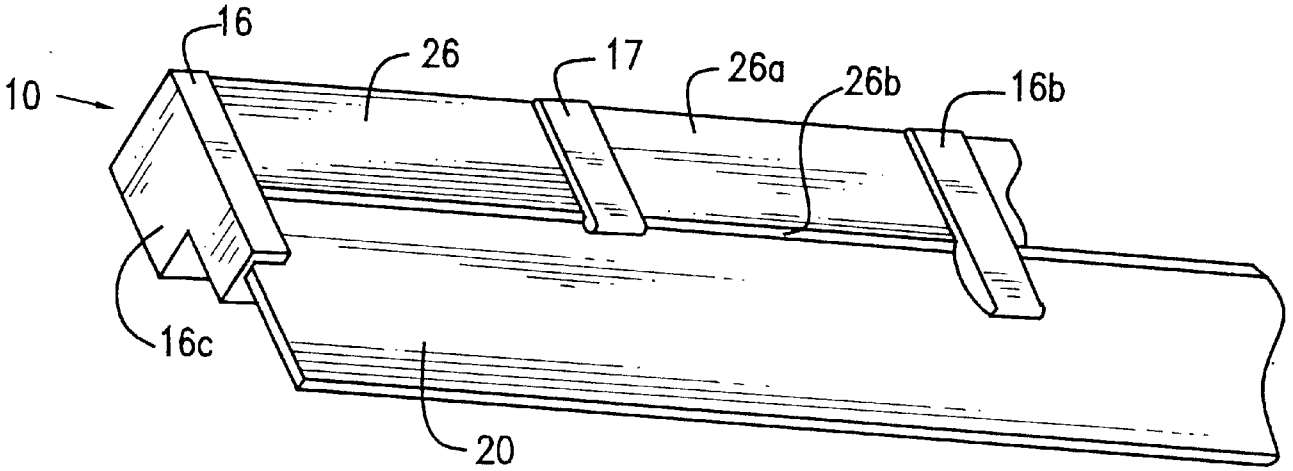
FIG. 16 is a bottom perspective view of the connector of FIG. 14 supporting a printed circuit board.
Figure 17:
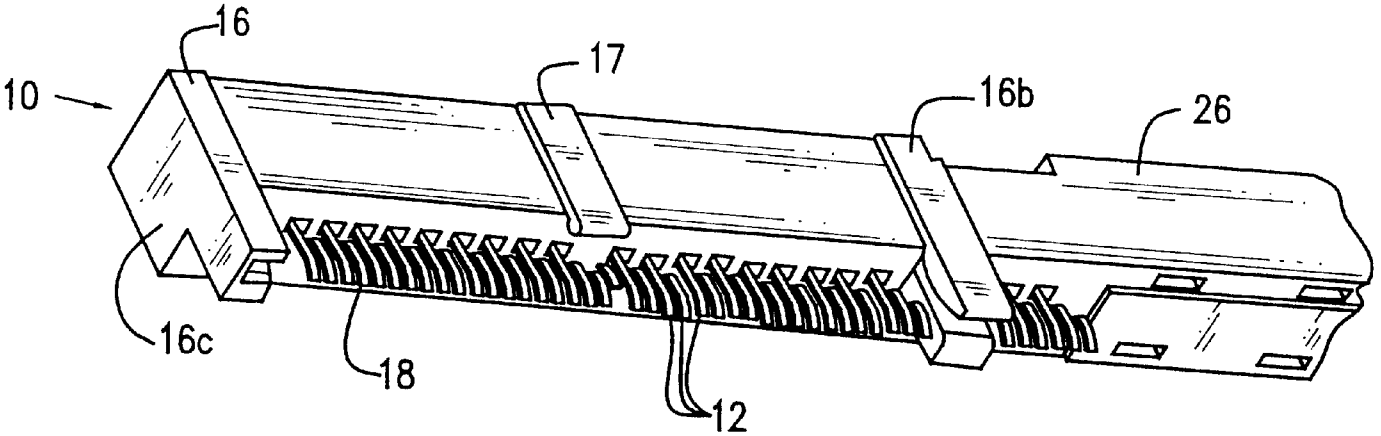
FIG. 17 is a bottom perspective showing of the connector of FIG. 14.

Referring now to FIGS. 14–17, single-sided straddle mount connector 10 may additionally include an intermediate protrusion 17 which, as particularly shown in FIGS. 16 and 17, is supported along a bottom surface 26*a* of housing 26 and extends forward of a front edge 26*b* thereof. Protrusion 17 which serves as an additional gripper arm is located approximately equidistant between gripper arm 16*c* and gripper arm 16*b*. Between such expanse, connector 26 supports at least one row of densely arranged signal contacts having solder tails 18 extending therefrom. While the arrangement of the gripper arm 16*a*, 16*b* and 16*c* described above adequately provides for a certain degree of non-coplanarity of solder tails 18 and a certain degree of printed circuit board warpage, the positioning and location of intermediate protrusion 17 compensates for additional non-coplanarity of the solder tails and a higher degree of printed circuit board warpage.

Non-coplanarity of the solder tails as well as printed circuit board warpage, especially along the solder tails 18 of the signal contacts, can result in incidents of non-soldered connections between certain of the solder tails 18 and the traces on the printed circuit board. Such problems are especially encountered when the connector is being implemented by the end user where variations in the thicknesses of the printed circuit board may result in a relatively thin board being employed. Such a thin board would enhance the above noted problems. Also storage of these boards at a user's location may, over time, result in enhanced warpage problems. Still further during the soldering process, PC boards have a tendency to be warped or deformed when exposed to high temperatures necessary for effecting a proper solder. Problems my also be encountered in the connector itself. In certain instances, warpage or deformation of the plastic connector housing is possible due to built-in molding stresses which may occur during the formation of the connector or due to high temperature exposure during the soldering process.

The addition of intermediate protrusion 17 additionally addresses such problems and results in more accurate and reliable solder connections between solder pads 18 and the traces on printed circuit board 20. This is especially significant along the extent between gripper arm 16*b* and end gripper arm 16*c* such extent being unsupported in the embodiment shown above in FIGS. 4, 6 and 7.

As set forth above, protrusion 17 may be integrally formed with connector housing 26. Protrusion 17, along with gripper arms 16*b* and 16*c*, forms a board receiving space with solder tails 18 for receipt of the edge of board 40. The board receiving space is such that the solder tails are biased against the edge of printed circuit board 40 assuring spring engagement therewith so as to compensate for lack of coplanarity of the tails along the entire row of contacts. Further, the upper surface 17*a* of protrusion 17 may include a central crush rib 17*b* extending therefrom for engagement with board 40 to help maintain the board 40 in place. The crush rib 17*b* may also be used to locate and align the board in the board receiving space.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A connector for mounting to the edge of a printed circuit board having solder pads on one side thereof, said connector comprising:

an elongate insulative housing having a top wall, an opposed bottom wall and spaced apart end walls;

a plurality of electrical contacts supported by said housing along the length thereof in at least one row, said contacts having spring biased solder tails extending from said housing for resilient electrical engagement with said solder pads on said one side of said printed circuit board;

a pair of gripper arms formed with said housing and extending from said housing adjacent each end of said row of said contacts in facing opposition to said solder tails, said gripper arms forming with said contact solder tails a board receiving space for resilient accommodation of said board therebetween; and an intermediate protrusion formed with and extending from said housing at a location intermediate said pair of gripper arms in facing opposition to said solder tails, said intermediate protrusion and said solder tails further defining said board receiving space.

2. A connector of claim 1 wherein said intermediate protrusion is positioned generally equidistant between said pair of gripper arms.

3. A connector of claim 2 wherein said intermediate protrusion has a first surface for engagement with said printed circuit board.

4. A connector of claim 3 wherein said first surface of said intermediate protrusion includes an upwardly projecting crush rib.

5. A connector of claim 2 wherein one said gripper arm of said pair is positioned adjacent one end wall of said housing.

6. A connector of claim 5 wherein the other said gripper arm of said pair is positioned inwardly of the other end wall of said housing.

* * * * *